US009334648B2

(12) United States Patent
Segas et al.

(10) Patent No.: US 9,334,648 B2
(45) Date of Patent: May 10, 2016

(54) SYSTEMS AND METHODS FOR PROVIDING BASE ISOLATION AGAINST SEISMIC ACTIVITY

(71) Applicants: Paul J. Segas, Napa, CA (US); Don Clyde, Napa, CA (US)

(72) Inventors: Paul J. Segas, Napa, CA (US); Don Clyde, Napa, CA (US)

( * ) Notice: Subject to any disclaimer, the term of this patent is extended or adjusted under 35 U.S.C. 154(b) by 0 days.

(21) Appl. No.: 14/560,798

(22) Filed: Dec. 4, 2014

(65) Prior Publication Data

US 2015/0300013 A1 Oct. 22, 2015

Related U.S. Application Data

(63) Continuation of application No. 14/106,240, filed on Dec. 13, 2013, now Pat. No. 9,097,027.

(60) Provisional application No. 61/793,172, filed on Mar. 15, 2013.

(51) Int. Cl.

| | |
|---|---|
| ***E04B 1/98*** | (2006.01) |
| ***E04H 9/02*** | (2006.01) |
| ***E04B 5/43*** | (2006.01) |
| ***E04F 15/024*** | (2006.01) |
| *E04F 15/22* | (2006.01) |

(52) U.S. Cl.

CPC ... *E04B 5/43* (2013.01); *E04B 1/98* (2013.01); *E04B 1/985* (2013.01); *E04F 15/024* (2013.01); *E04F 15/225* (2013.01); *E04H 9/02* (2013.01); *E04H 9/021* (2013.01); *E04F 15/22* (2013.01)

(58) Field of Classification Search

CPC ..... E04H 9/021; E04H 9/02; E04F 15/22; E04F 15/225; E04B 1/985; E04B 1/98

USPC ..... 52/167.4, 167.9, 167.8, 167.1, 167.2; 384/25

See application file for complete search history.

(56) References Cited

U.S. PATENT DOCUMENTS

| | | | | |
|---|---|---|---|---|
| 4,121,393 | A * | 10/1978 | Renault et al. | 52/167.7 |
| 4,553,792 | A * | 11/1985 | Reeve | 384/26 |
| 4,554,767 | A * | 11/1985 | Ikonomou | 52/167.9 |
| 5,867,951 | A * | 2/1999 | Yaguchi et al. | 52/167.4 |
| 5,946,866 | A * | 9/1999 | Weglewski et al. | 52/167.1 |
| 6,289,640 | B1 * | 9/2001 | Ueda et al. | 52/167.9 |
| 6,826,873 | B2 * | 12/2004 | Valencia | 52/167.2 |
| 8,402,702 | B1 * | 3/2013 | Villaverde | 52/167.7 |
| 9,097,027 | B2 * | 8/2015 | Clyde et al. | |
| 2008/0222975 | A1 * | 9/2008 | Nakata et al. | 52/167.9 |
| 2009/0094906 | A1 * | 4/2009 | Sato | 52/167.4 |
| 2011/0011013 | A1 * | 1/2011 | Kanazawa | 52/167.9 |

* cited by examiner

*Primary Examiner* — Chi Q Nguyen
(74) *Attorney, Agent, or Firm* — Greenberg Traurig, LLP

(57) ABSTRACT

A pedestal base isolation system assembly including a base plate having an anchoring layer and a top plate slidably positioned above the base plate. At least one of the top and base plates includes a textured surface, wherein desired coefficients of static and kinetic friction between the top plate and the base plate prevent relative movement of the two plates with normal operation and yet allow the top plate to move relative to the base plate during a seismic event. In one example, the sliding surface has a coating such as a polyester (e.g., polyester triglycidyl isocyanurate) or a low surface energy coating (e.g., silicone-epoxy coating). In another example, the seismic isolation system further includes a pedestal for supporting an object on the isolation assembly.

17 Claims, 9 Drawing Sheets

SYSTEMS AND METHODS FOR PROVIDING BASE ISOLATION AGAINST SEISMIC ACTIVITY

CROSS REFERENCE TO RELATED APPLICATION

This application is a continuing application claiming priority to U.S. application Ser. No. 14/106,240, filed Dec. 13, 2013, entitled "Systems and Methods for Providing Base Isolation against Seismic Activity," now U.S. Pat. No. 9,097,027, which claims priority to U.S. Provisional Application Ser. No. 61/793,172, filed on Mar. 15, 2013, entitled "Methods and Apparatus for Providing Base Isolation to Protect Against Earthquake Damage," each of which is incorporated herein by reference in its entirety.

FIELD OF THE DISCLOSURE

The present disclosure generally relates to seismic isolation systems, and more particularly to systems and methods for providing base isolation against seismic activity, blast waves, and the like.

BACKGROUND

Seismic isolation systems, such as floors or plates designed to isolate equipment from sudden foundational shifts can be important in various applications. In particular, seismic base isolation systems are oftentimes powerful tools of earthquake engineering and often used to isolate non-structural contents of a building and/or sensitive equipment against sudden ground motions, which may be caused by a seismic event, such as earthquake, a natural event, a blast wave, etc. Typical applications for seismic isolation systems including buildings with high value assets, such as data centers, hospitals, museums, manufacturers with critical equipment, warehouses, laboratories and/or any application where it is important to protect critical assets. The goal of any seismic isolation system is to maximize safety, business continuity, and preservation of irreplaceable items.

For example, U.S. patent application Ser. No. 13/578,868 discloses a seismic isolation device including a tabular base board having a plurality of curved convex protrusions formed thereon and a sliding plate having a sliding contact surface that is slidingly in contact with the plurality of curved convex protrusions and placed on a side of the convex protrusions of the base board, wherein the sliding contact surface of the sliding plate includes a plurality of high-friction portions arranged corresponding to the plurality of curved convex protrusions and enabling stable rest in a contact state with the plurality of the curved convex protrusions and a sliding surface other than the high-friction portions that has a lower apparent friction coefficient than the high-friction portions.

For another example, PCT Patent Application No. PCT/JP2012/006003 discloses a method for installing seismic isolation floor which comprises: a base disposition step in which a plurality of planar bases, each formed by arranging a plurality of upward convex curved surface portions on the upper surface thereof, are disposed on the upper surface of a floor by being installed on a plurality of lines of double-sided tape attached to the upper surface of the floor approximately parallel to each other; and a glide plate installation step in which a plurality of planar glide plates each having an approximately flat shaped lower surface are installed on the bases.

One challenge in designing a seismic isolation system of this type of construction is to construct a base plate having an appropriate coefficient of friction. Seismic isolation systems require low coefficients of kinetic and static friction so that when the ground or the foundational surface shakes, the supported body does not move. However, if the coefficient of static friction is too low, the supported body may easily move during regular use. The challenge in designing a seismic isolation system is to identify coefficients of static and kinetic friction that meet both needs.

The other challenge is to design a damping system for providing displacement control during a seismic event. While conventional damping systems usually require external curb or dampers to limit the movement of a seismic isolation system, the challenge is to design a damping system that uses internal chambers and dampers to save space.

DETAILED DESCRIPTION

Figure 1A:
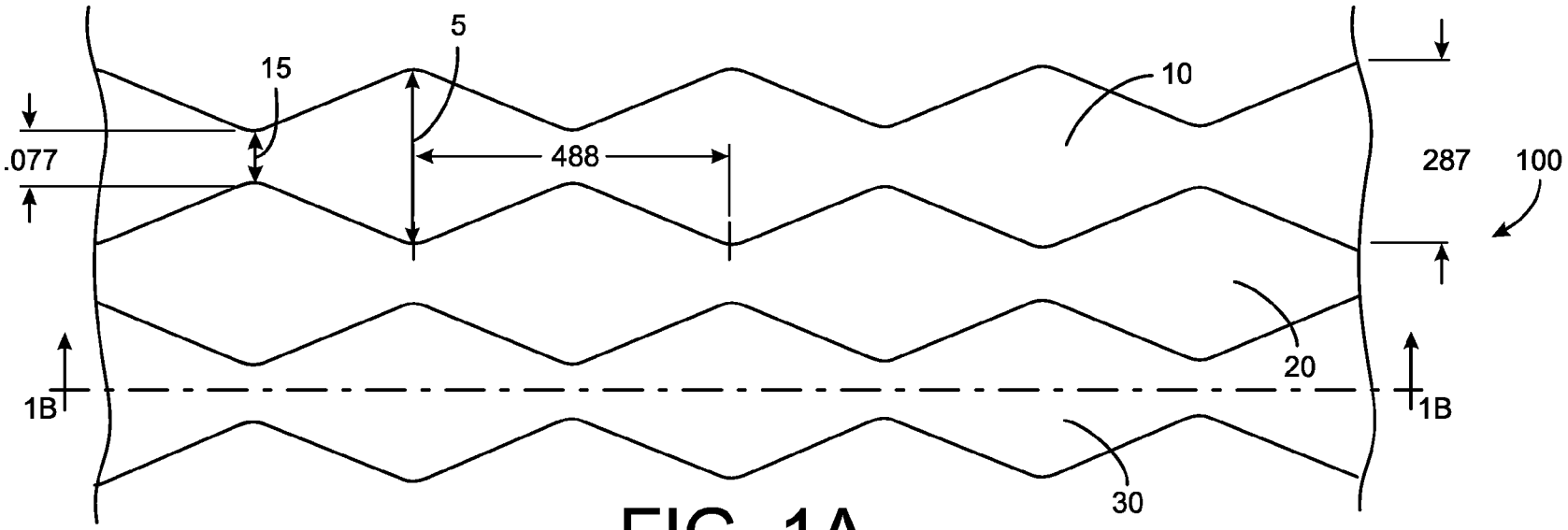
FIG. 1A is a top view of a base plate of a seismic isolation system in accordance with the present disclosure.

The following description of example methods and apparatus is not intended to limit the scope of the description to the precise form or forms detailed herein. Instead, the following description is intended to be illustrative so that others may follow its teachings.

Described herein is a technology for, among other things, providing base isolation to protect non-structural contents of a building and/or sensitive equipment from sudden ground motions, such as an earthquake, blast wave, or other event. In one example, the disclosure relates to a seismic isolation system comprising at least a base plate and a top plate. The base plate is positioned above a foundation, such as a ground, floor, building, tile, and/or any other suitable foundational structure. For example, the base plate can be attached to or fixed on the foundation. One of ordinary skill in the art will recognize that a foundation can be any supporting layer of a structure, and a floor can be the walking surface of a room, which may vary from simple dirt to many-layered surfaces using modern technology, such as stone, wood, bamboo, metal, or any other material that can hold a person's or equipment's weight.

In addition, the coefficients of static and kinetic friction between the top plate and the base plate can prevent relative movement of the two plates with normal operation and yet allow the top plate to move relative to the base plate during a seismic event. In particular, the coefficient of kinetic friction is low so that the top plate can move relative to the base plate during a seismic event, but not too low in order to maintain the stability of the system when the top plate is moving; the coefficient of static friction is low so that the top plate can begin the movement when a seismic event occurs, but is sufficiently high to prevent the relative movement of the two plates with normal operation.

In one example, the bottom surface of the base plate is in communication with the foundation and the top surface of the base plate is in communication with the top plate. The bottom surface of the base plate is textured, so that the interface between the base plate and the foundation is not smooth. The top surface of the base plate is also textured while, in contrast, the bottom surface of the top plate (which interfaces with the base plate) is smooth or non-textured, resulting in the desired coefficients of kinetic and static friction between the top and base plates. In another example, an additional material (e.g., a lubricating fluid) may be deposited between the base plate and the top plate to achieve an optimal or desired coefficient of friction.

In one example, the base plate and the top plate may be designed to an optimal thickness. For example, each plate may be a maximum of about 4 mm thick. In another example, the base plate and/or the top plate may be corrosion-resistant.

In another example, the disclosed base plate is textured with diamond-shaped ridges. Such diamond-shaped ridges create a textured surface and optimize the coefficients of static and kinetic friction between the base plate and the top plate in order to maximize the stability of seismic isolation system both while the foundation is moving, and when the foundation is not moving.

In accordance with the present disclosure, a sliding surface (e.g., foundation, base plate, or top plate) has a coating in order to achieve the desired coefficients of kinetic and static friction. The coating may be made of a material such as polyester. For instance, in one example, the base plate is made of a suitable material (e.g., steel) and coated with polyester triglycidyl isocyanurate (TGIC polyester), a commercially available polyester powder coating. In another example, the sliding surface is coated with a silicone-epoxy, low surface energy coating.

In operation, the disclosed seismic isolation system is first placed above (e.g., fixed on) a foundation. For example, the base plate of the seismic isolation system can be attached directly to a ground, floor, building, or floor tiles via adhesive, fasten, or other suitable mechanism or methods. In another example, an epoxy plate can be placed between the base plate and the floor. After the base plate is installed, the top plate is then placed above the base plate. Alternatively, an additional material (e.g., lubricate liquid) may be added between the base plate and the top plate to achieve the desired coefficients of kinetic and static friction. Moreover, one of ordinary skill in the art will recognize that the number, size, and shape of the plate or plates may vary as desired.

Further, an object to be protected is placed above the top plate of the system. The object is usually a high value content and/or sensitive equipment, such as critical equipment in data centers, hospitals, museums, manufactures, warehouses, and laboratories but may be any item as desired. Of course, it will be understood by one or ordinary skill in the art that the worth of the object is irrelevant to the seismic isolation system described. In one example, the object is attached directly to the top plate while in others, the item merely rests upon the top plate. In still another example, the object (e.g., server cabinet) may be bolted to a slab (e.g., 4 inches concrete slab) with the slab then placed or poured directly on the top plate.

In still other instances, the object may be placed on a raised access floor, where cable or air flow in the access floor is unrestricted. The raised access floor can be a raised floor providing an elevated structural floor above the solid foundation to create a hidden void for the passage of mechanical and electrical services. For example, the raised access floors are widely used in command centers, IT data centers, and computer rooms, where there is a requirement to route mechanical service, cable, wiring, and electrical supply. Such a raised access floor may be directly attached to the top plate of the seismic isolation system. In other examples, the object may be placed on a raised access floor while the raised access floor is bolted to a slab (e.g., 4 inches concrete slab) resting on the top plate, wherein the object may be bolted to the concrete slab as well.

In another example, one or more external dampers or neoprene pads are mounted beside the raised access floor or the concrete slab resting on the top plate, in order to limit and/or damp the movement of the raised access floor or the concrete slab in an earthquake. For example, the external dampers may be mounted on the sidewalls in the corner and displacement of the top plate relative to the bottom plate may be limited by such damper units. The access floor can also be strengthened in the corner to provide resistance to the dampers. Another example is that a perimeter or "moat" gap can be cushioned by external dampers so that the concrete slab's displacements are limited.

The present disclosure also relates to a seismic isolation system with a damping system. In one example, a seismic isolation system includes a base plate; a top plate positioned above the base plate and capable of moving relative to the top plate; and a damping system comprising a slab (e.g., concrete slab) positioned on the upper surface of the top plate and capable of moving together with the top plate, wherein the slab comprises one or more recessed areas at its bottom, and under the recessed area at least part of the base plate is uncovered by the top plate. The damping system can further include one or more internal dampers (e.g., neoprene dampers) mounted on the uncovered part of the base plate or the foundation under the recessed area and capable of limiting or damping the movement of the slab.

The coefficients of static and kinetic friction between the top plate and the base plate may prevent relative movement of the two plates with normal operation and yet allow the top plate to move relative to the base plate during a seismic event. For instance, the base plate has a textured top surface and the top plate has a non-textured bottom surface, and optionally at least one of the top surface or the bottom surface of the base plate is textured with diamond-shaped ridges.

In one example, the disclosed base plate can be installed on a foundation. The top plate positioned above the base plate can slide on the base plate in an earthquake due to the low coefficient of kinetic friction, yet retain its stability with normal operation of the building due to the desired coefficient of static friction. In one example, the concrete slab rests on the top plate and the internal dampers are within the concrete slab, i.e., within the internal chamber created by the recessed area and the plate under such area. Because these internal dampers are mounted on the base plate, when the concrete slab or the top plate moves on the base plate in an earthquake, the internal dampers are capable of providing displacement control by communicating with or sliding along inside concrete wall(s) of the internal chamber.

In one example, the dampers are designed to operate in compression only. During an earthquake, the isolated slab moves in both X and Y directions of the horizontal plane. The dampers may be designed to be compressed against the contacting surface (e.g., the inside concrete wall) in the longitudinal direction and to slide along in the lateral direction with a minimal shear force. In one example, the sliding/damping surfaces comprise mirror finish diamond deformed stainless steel plate against a low surface energy coated plate. The dampers may have a thickness between 2.5 to 4 inches and/or depth between 8 to 10 inches in order to be installed within the slab. The dampers may also be restrained from buckling by the foundation below and the cover slab above.

In one example, any or all of the sliding surfaces in this seismic isolation system (e.g., base plate, top plate, damper face, or inside concrete wall) have a coating to achieve desired coefficients of kinetic and static friction. Examples of the coating include polyester triglycidyl isocyanurate and a low surface energy coating (e.g., waterborne, silicone-epoxy material). For instance, at least one of the base plate, the face of the damper, or the inside wall is made of a material (e.g., steel) and coated with polyester triglycidyl isocyanurate or a silicone-epoxy, low surface energy material. In one example, the face of the damper and/or the inside wall may comprise the same material as the base plate and optionally are textured with diamond-shaped ridges. Still in another example, a lubricant is deposited between the sliding surfaces to achieve the desired coefficients of static and kinetic friction.

The design of compressed dampers and coating for sliding/damping surfaces allows inside walls of the slab to slide along the face of dampers. Without such design, any shear forces would damage the dampers during the earthquake. By sliding along the face of the damper, however, the damage is eliminated and the forces are transferred longitudinally into the damper for maximum damping effect.

As described above, this seismic isolation system with internal damping system does not require external curb or dampers to be installed. Additionally, cable, wiring, or electrical equipment can be placed within the recessed areas, particularly useful for installation of a data center. Moreover, one of ordinary skill in the art will recognize that the size, location, shape, and number of the recessed area(s) may vary according to the desired configuration of a room.

The present disclosure also relates to methods for providing base isolation against earthquake forces. The disclosed method includes at least one of the following steps: installing a base plate on a foundation (e.g., floor or ground), wherein the base plate has a textured top surface; optionally adding an additional material (e.g., lubricating fluid) on the base plate; installing a top plate on the base plate, wherein the top plate has a non-textured bottom surface; optionally installing a slab (e.g., a concrete slab) above the top plate; optionally installing a raised access floor above the top plate or the slab; installing an equipment above the top plate, wherein the equipment is optionally bolted to the slab or the raised access floor; optionally installing external dampers beside the slab or the raised access floor, or installing internal dampers within the slab, wherein a desired coefficient of kinetic friction between the base plate and the top plate permits the top plate to move in an earthquake, but retain the stability in regular use absent sudden ground motions, wherein the external dampers or internal dampers are capable of providing displacement control in the earthquake.

Figure 1B:
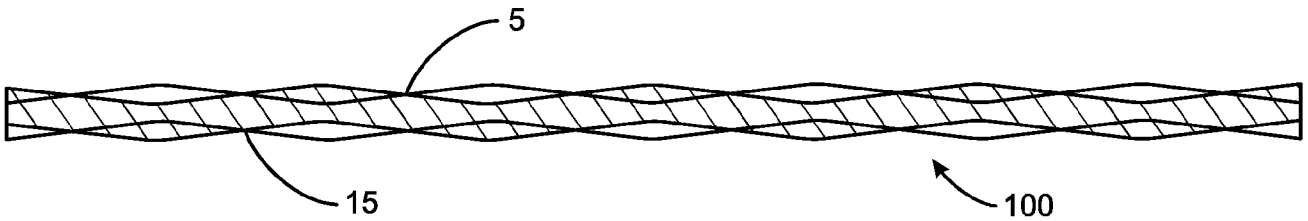
FIG. 1B is a cross-sectional side view of the base plate in FIG. 1A.

Turing to figures, FIGS. 1A and 1B together illustrate an example base plate 100 in accordance with the present disclosure. FIGS. 1A and 1B depict a top and side view of the disclosed base plate 100, respectively. As shown in FIG. 1A, the example base plate 100 is textured with diamond-shaped ridges, although any type of ridges and/or protrusions will suffice. In particular, FIG. 1A depicts three adjacent ridge regions 10, 20, 30. The ridge regions 10, 20, 30 alternate in the sense that the ridge region 10 and the ridge region 30 are parallel to each other. In the meantime, the ridge region 20 is complementary, or in other words, phase shifted as compared to the ridge regions 10 and 30. Further, each of ridge regions 10, 20, 30 comprises multiple wide portions 5 and narrow portions 15.

As shown in FIG. 1B the wide portion 5 of each ridge region is raised, while the narrow portion 15 of each ridge region is depressed. Moreover, the wide ridge portions 5 are raised on both the top and bottom surfaces of the base plate 100. In this way, the alternatingly-raised, complementary ridge regions create a textured surface. The disclosed diamond-shaped ridges optimize both the coefficients of static and kinetic friction between the base plate 100 and a top plate 102 (FIG. 2) in order to maximize the stability of the seismic isolation system both while the foundation is moving, and when the foundation is not moving. The base plate 100 or the top plate 102 may be designed to an optimal thickness. For example, each plate may be a maximum of 4 mm thick.

In accordance with the present disclosure, the coating of any sliding surface (e.g., base plate, top plate, foundation, face of damper, and inside wall of slab) may be made of a material, such as polyester or low surface energy coating, in order to optimize the coefficients of static and kinetic friction. Tables 1-3 are data sheets describing the properties of three example coating materials, i.e., polyester triglycidyl isocyanurate (TGIC polyester), a waterborne, silicone-epoxy, low surface energy coating ("EC-2600"), and a silicone-epoxy coating ("EC-2400"). As shown in Table 1, the coating is made of polyester triglycidyl isocyanurate (TGIC polyester), a commercially available polyester powder coating. Table 2 shows that the coating may also be made of "EC-2600," a waterborne, silicone-epoxy, low surface energy coating having excellent release, slip, and abrasion resistance properties along with a broad range of adhesion capabilities to various substrates. As shown in Table 3, the coating is made of "EC-2400," a silicone-epoxy coating used in areas where maximum abrasion resistance, low surface energy, coupled with good non-stick, easy clean properties are required including floors. In one example, the epoxy-silicone coating EC-2600 may be used to achieve 2% friction; and the coating EC-2400 may be used to achieve 5% friction. In one example, the epoxy-silicone coating EC-2400 or EC-2600 may be sprayed with airless or conventional spray equipment. The suggested spray equipment and settings are shown in Table 4.

TABLE 1

| Type: TGIC-Polyester | | |
|---|---|---|
| POWDER PROPERTIES | | |
| ASTM D5965-96, C | Specific Gravity | 1.29 ± 0.05 |
| | Theoretical Coverage | 149 $ft^2$/lb/mil |
| ASTM D3451-92, 13 | Mass Loss During Cure | <1% |
| | Recommended Shelf Life: | 12 Months @ 75° F. |
| COATING PROPERTIES | | |
| ASTM D523-89 | Gloss at 60° | 85+ |
| DPC TM 10.219 | PCI Powder Smoothness | 8 |
| ASTM D2454-95 | Overbake Resistance, Time | 100% |
| ASTM D3363-92a | Pencil Hardness | 2H |
| ASTM D2794-93 | Dir/Rev Impact, Gardner | 160/160 in/lbs |
| ASTM D3359-97 | Adhesion, Cross Hatch (minimu | 5B Pass |
| ASTM D522-93a | Flexibility, Mandrel | ⅛ in. dia., no fracture |
| ASTM B117-97 | Salt Spray | 1,000 hrs |
| UL DTOV2 | Steel Enclosures, | Recognized |
| Organic Coating | Elect. Eq. | |
| APPLICATION | | |
| Electrostatic Spray, Cold | | CURE SCHEDULE: |
| Substrate: 0.032 in. CRS | | (Time at substrate temperature) |
| Pretreatment: Bonderite ® 1000, | | 10 Minutes @ 400° F. |
| Parcolene ® 60 | | FILM THICKNESS: 2.0-2.5 Mils |

TABLE 2

EC-2600-B

I. PHYSICAL DATA

Boiling Point: >150° F.
Specific Gravity ($H_20$ = 1): >1.0
Vapor Pressure (mm Hg and Temperature): <1.3 mm Hg @ 20° C.
Melting Point: N/A
Vapor Density (Air = 1): Lighter than air
Evaporation Rate (Butyl Acetate = 1): Slower than Butyl Acetate
Solubility in Water: Soluble
PHYSICAL CHARACTERISTICS Shelf Life: 10 Mos. (Unopened) Storage: Do Not Freeze or Expose To High Heat
Coating Type: Silicone/Epoxy Waterborne Color: Various
Pot life: 60 min. @ 68° F. Induction Time: None Solids: by weight 52% Mimimum Application/Drying Temperature: 50 F. Coverage Rate: Approx. 220 sq. ft. @ 3 mil DFT Tensile Strength: >1750 psi Elongation: ASTM 2370 >5% Adhesion: ASTM D451 >1000 psi Abrasion: (CS 17/Kg/1000 cycles) <38 mg loss Cure Time: Complete in 5 days at room temperature. Dry to the touch in 2 hours. Force Cure: 300° F. for 30 min or 150° F. for 4 hours. Many applications can be returned to service the next day. VOC: ASTM 3960-1.1#/gl. Heat Resistance: Do Not exceed 325° F. continuous service.

II. MATERIAL IDENTIFICATION AND INFORMATION

| COMPONENTS - Chemical Name & Common Names (Hazardous Components 1% or greater; Carcinogens 0.1% or greater) | % | OSHA PEL | ACGIH TLV | OTHER LIMITS RECOMMENDED |
|---|---|---|---|---|
| Polyamine Solution Cas# 68410-23-1 | 47 | . . . | . . . | . . . |
| 2-Propoxyethanol Cas# 0028007-30-9 | 26 | . . . | . . . | . . . |
| Methyl Alcohol Cas# 67-56-1 | 2 | 200 ppm Skin TWA | 250 ppm Skin STEL | . . . |
| Proprietary Resin/Pigment Mixture | 8 | | | |
| . . . Not Established | | | | |
| Non-Hazardous Ingredients | 17 | | | |
| TOTAL | 100 | | | |

TABLE 3

EC-2400-B

I. PHYSICAL DATA

Boiling Point: >150° F.
Specific Gravity ($H_20$ = 1): >1.0
Vapor Pressure (mm Hg and Temperature): <1.3 mm Hg @ 20° C.
Melting Point: N/A
Vapor Density (Air = 1): Lighter than air
Evaporation Rate (Butyl Acetate = 1): Slower than Butyl Acetate
Solubility in Water: Soluble TABLE 3-continued

| EC-2400-B |
|---|
| PHYSICAL CHARACTERISTICS |
| Shelf Life: Unopened, up to 6 Months if shaken well monthly. Storage: Do Not Freeze or Expose To High Heat. Coating Type: Silicone/epoxy water-based Color: Various (contact Ecological Coatings) Pot life: 60 min. @ 68° F. Induction Time: None Solids: by weight 50% Coverage Rate: Approx. 170 sq. ft. @ 4 mil DFT Tensile Strength: >1750 psi Elongation: ASTM 2370 >5% Adhesion: ASTM D451 >1000 psi Abrasion: (CS 17/Kg/1000 cycles) <40 mg loss Cure Time: Complete in 5 days at room temperature. Dry to the touch in 2 hours. Force Cure: 300° F. for 30 min or 150° F. for 4 hours. Many applications can be returned to service the next day. VOC: ASTM 3960-1.2#gl. Heat Resistance: Do Not exceed 300° F. continuous service. |

II. MATERIAL IDENTIFICATION AND INFORMATION

| COMPONENTS - Chemical Name & Common Names (Hazardous Components 1% or greater; Carcinogens 0.1% or greater) | % | OSHA PEL | ACGIH TLV | OTHER LIMITS RECOMMENDED |
|---|---|---|---|---|
| Polyamine Solution Cas# 68410-23-1 | 47 | . . . | . . . | . . . |
| 2-Propoxyethanol Cas# 0028007-30-9 | 26 | . . . | . . . | . . . |
| Methyl Alcohol Cas# 67-56-1 | 2 | 200 ppm Skin TWA | 250 ppm Skin STEL | . . . |
| Proprietary Resin/Pigent Mixture | 9 | | | |
| . . . Not Established | | | | |
| Non-Hazardous Ingredients | 17 | | | |
| TOTAL | 100 | | | |

TABLE 4

| Suggested Spray Equipment & Settings (Epoxy-Silicone Coatings) |
|---|
| Airless Spray Equipment |
| Large Volume "Graco" System: |
| 45:1 Ratio Pump<br>Tip Pressure 4000 psi<br>Tip Orifice 0.017 with 8"-10" width spray fan or 0.019 with 10"-12" width spray fan.<br>Minimum hose diameter of 10 mm.<br>Adjust viscosity only when required. |
| Small Volume "Wagner" System: |
| Adjust viscosity before coating.<br>Use "H" size tip for heavy materials.<br>Use atomizer valve for latex paint.<br>Adjust pressure control knob for proper atomization. |
| Conventional Spray Equipment |
| Siphon Feed System: |
| Binks No 7 Siphon Feed Gun<br>Fluid and Air Nozzle 36 X 36 SD<br>Fluid Needle No 36<br>Air Cap (Nozzle retaining ring) 54-704<br>Atomizing Pressure 40-50 psi |
| Pressure Pot System: |
| Binks No 7 Gun<br>Fluid and Air Nozzle 36 X 36 P<br>Fluid Needle No 36<br>Air Cap (Nozzle retaining ring) 54-704<br>Atomizing Pressure 40-50 psi<br>Pot Pressure 15-30 psi |

Figure 2:
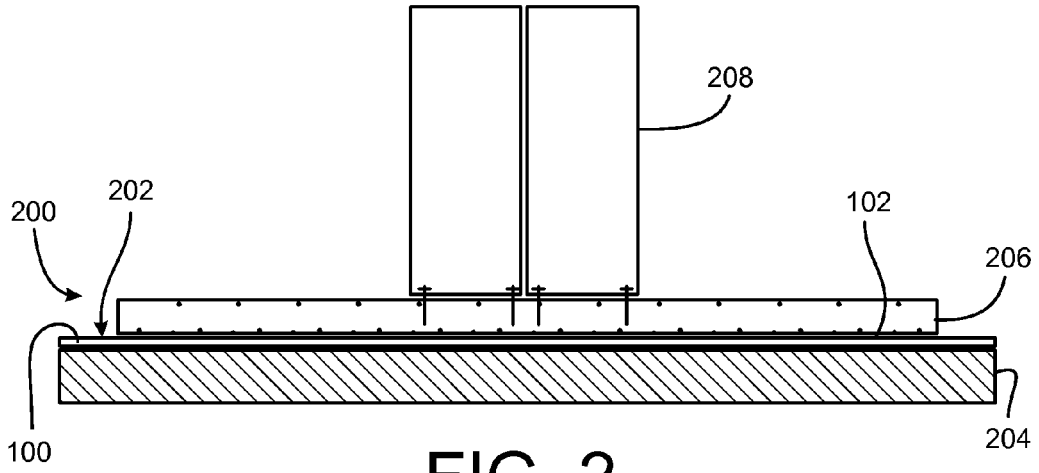
FIG. 2 illustrates an example configuration of a seismic isolation system in accordance with the present disclosure.

FIGS. 2-5 illustrate various configurations of the seismic isolation system in accordance with the present disclosure. As shown in FIG. 2, the seismic isolation system 200, which includes the base plate 100 and the moveable top plate 102 positioned above the base plate 100 (collectively called sliding plates 202), is placed above a foundation 204. The foundation 204 can be a floor, a ground, floor, building, floor tiles, or any other suitable base. The concrete slab 206 is placed above the sliding plates 202, and in this example is anchored to the sliding plate 102. In one example, the concrete slab 206 has a thickness of about four inches. The objects (e.g., server cabinets 208) are bolted directly to the concrete slab 206. In case of an earthquake or sudden ground motions, the desired coefficient of kinetic friction between the top and base plates allows the top plate 102, together with the concrete slab 206 and server cabinets 208 above the top plate 102, to slide or move, while the desired coefficient of static friction between the two sliding plates 202 prevent sliding with normal operation. As such, the motion between the base plate 100 and the top plate 102 isolates the server cabinets 208 from earthquake accelerations. In some examples, this configuration may be utilized for ground floor or overhead cabling and cooling.

Figure 3:
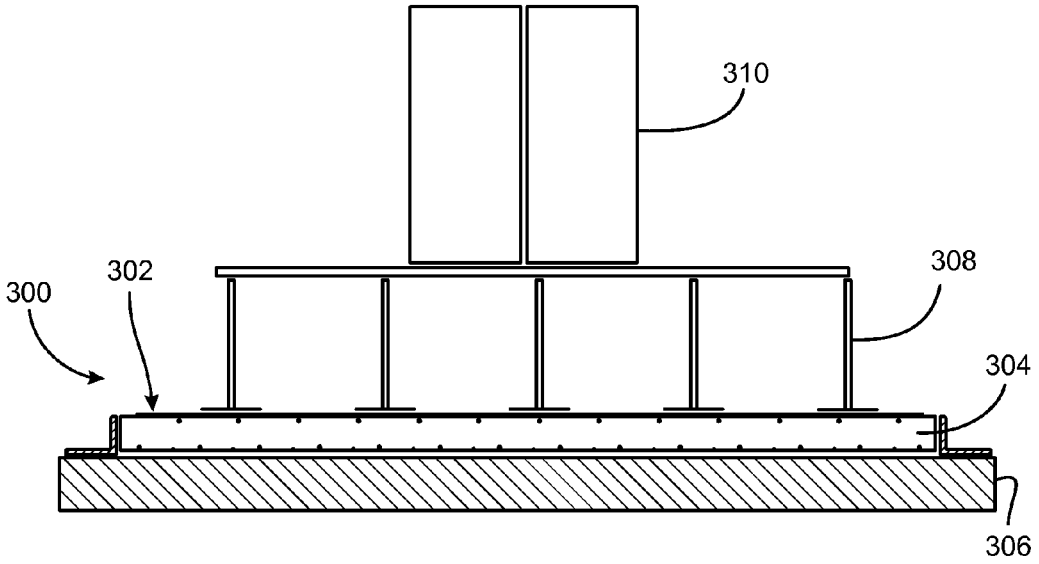
FIG. 3 illustrates an example configuration of a seismic isolation system with a raised access floor in accordance with the present disclosure.

FIG. 3 provides another example configuration of the seismic isolation system 300 in accordance with the present disclosure. As shown in FIG. 3, an epoxy plate 304, which can be fixed on the foundation 306, is placed between the foundation 306 and the sliding plates 302 (i.e., the base plate and the moveable top plate above the base plate) of the seismic isolation system 300. A raised access floor 308 (e.g., a standard raised access floor) is attached directly to the sliding plates 302. The sever cabinets 310 or other objects to be isolated can be positioned on top of the raised access floor 308. Additionally, cable or air flow in access floor is not restricted.

Figure 4:
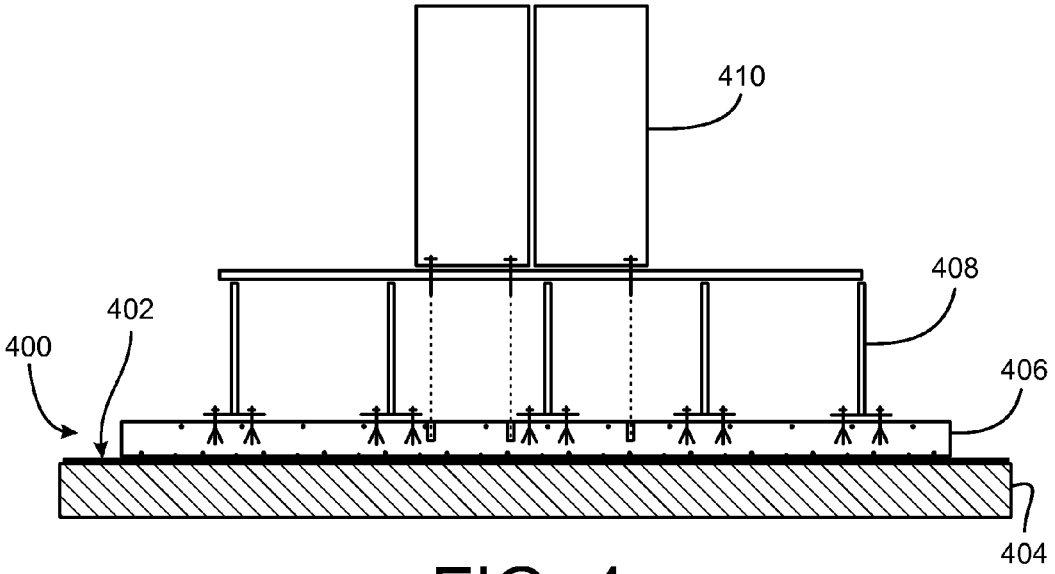
FIG. 4 illustrates another example configuration of a seismic isolation system with a raised access floor in accordance with the present disclosure.

FIG. 4 illustrates another example configuration of the seismic isolation system 400 in accordance with the present disclosure. In FIG. 4, the sliding plates 402 (i.e., the base plate and the top plate above the base plate) of the seismic isolation system 400 are positioned above the foundation 404 and below the concrete slab 406. In one example, the concrete slab has a thickness of about 4 inches. The standard raised access floor 408 is placed above and bolted to the concrete slab 406 resting on the sliding plates 402. The server cabinets 410 or other objects to be protected are placed above the raised access floor 408, and optionally are bolted to the concrete slab 406 as well. In one example, a perimeter or "moat" gap beside the concrete slab is cushioned by neoprene dampers. Therefore, when the top plate, together with the concrete slab 406 and the server cabinets 410, is moving in an earthquake, their displacements are limited by the external dampers beside the concrete slab 406.

Figure 5:
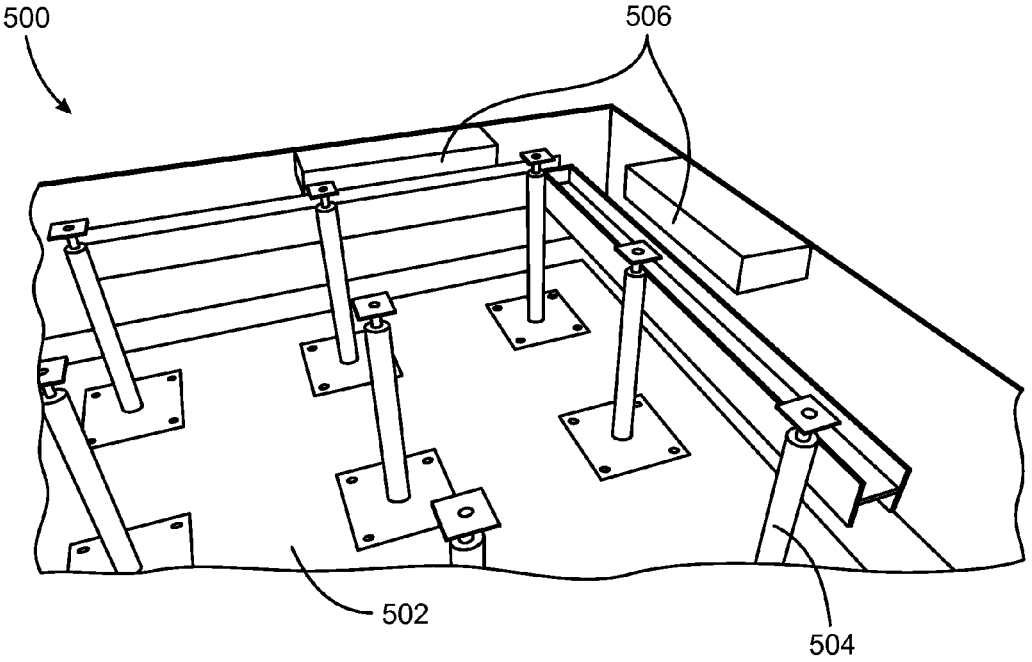
FIG. 5 illustrates an example configuration of a seismic isolation system with external dampers to control displacement of a raised access floor in accordance with the present disclosure.

Another example is shown in FIG. 5 in accordance with the present disclosure. The raised access floor 504 is positioned on the sliding plates 502 (i.e., the base plate and the top plate above the base plate) of the seismic isolation system 500. The desired coefficients of kinetic and static friction between the top plate and the base plate permit the motion between the base plate and the top plate to isolate the raised access floor 504 against earthquake forces. Meanwhile, the desired coefficient of static friction between the two plates prevents such motion during normal operation. Further, external dampers 506 are mounted at the corners in the proximity of the raised access floor 504. Accordingly, these external dampers 506 are capable of limiting the slide of the raised access floor 504 during an earthquake or other sudden ground motions.

Figure 6:
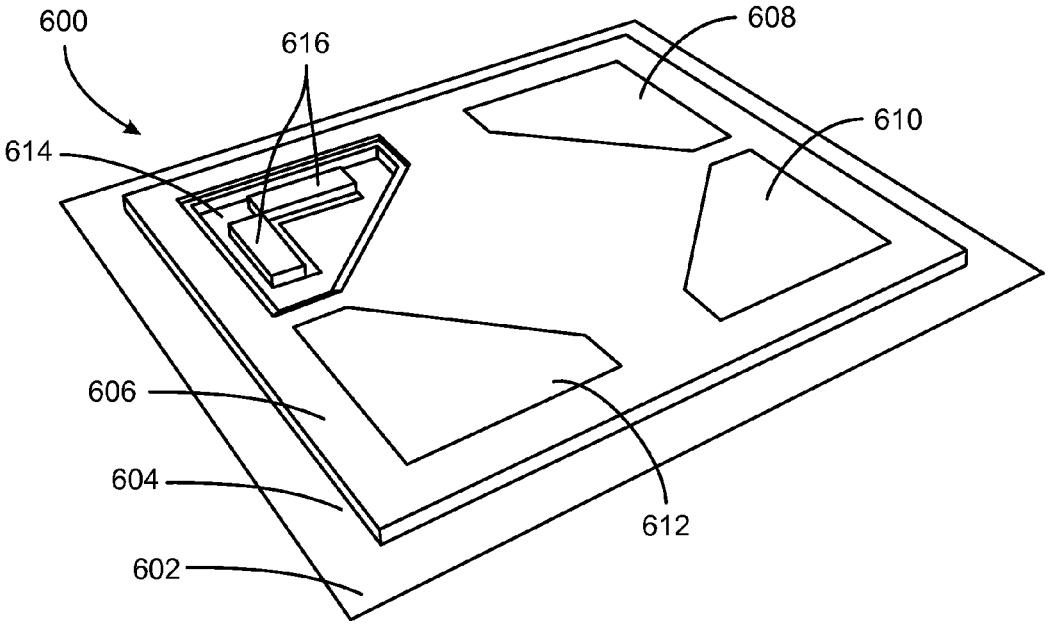
FIG. 6 illustrates an example configuration of a seismic isolation system with internal dampers to control displacement of a low profile foundation in accordance with the present disclosure.
Figure 7:
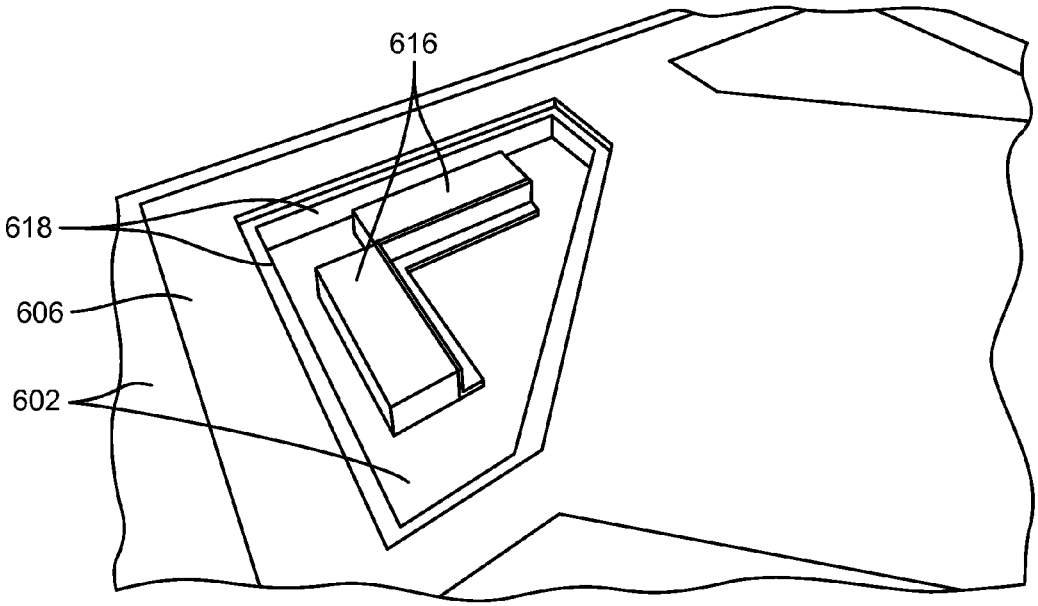
FIG. 7 is a close view of the seismic isolation system in FIG. 6.

Turning to FIGS. 6-10, these figures illustrate various examples of a seismic isolation system of the present disclosure with internal damping system. Such examples do not require external curb or dampers, but it will be understood that external devices may be used as desired. In specific, as shown in FIG. 6, the base plate 602 of the seismic isolation system 600 can be placed on a ground or foundation. The top plate 604 is positioned above the base plate 602, and the concrete slab 606 is then positioned above the top plate 604. The installed concrete slab has one or more recessed areas at its bottom and thus creates internal chamber(s) between the recessed areas and the plates thereunder. For example, the concrete slab 606 has four holes at its four corners, respectively. Each hole has a hole cover, so that once the holes are covered, the concrete slab has a flat top surface and four recessed areas at its bottom surface. FIG. 6 shows hole covers 608, 610, and 612, under each a recessed area is being created. For illustration purposes, FIGS. 6 and 7 also show an uncovered hole 614 to illustrate the internal structure of the recessed area. For areas exposed in the whole 614, at least part of the base plate 602 is uncovered by the top plate 604, so that dampers 616 can be mounted on the base plate 602. Similarly, under each of hole covers 608, 610, and 612 or recessed areas created thereunder, one or more dampers 616 are mounted on the part of the base plate that is uncovered by the top plate. As such, the dampers 616 are within the concrete slab 606. In an earthquake, the motion between the top plate 604 and the base plate 602 isolates the concrete slab 606, as well as objects on the top of the concrete slab 606. In the meantime, the dampers 616 within the concrete slab 606 can provide necessary displacement control, by communicating with the inside walls 618. The dampers 616 can be in communication with different inside walls in order to provide control in different directions.

In one example, the dampers 616 are designed to operate in compression only. During an earthquake, the concrete slab 606 moves in both X and Y directions of the horizontal plane. The dampers 616 may be designed to be compressed against the inside walls 618 in the longitudinal direction and to be able to slide along the concrete walls 618 in the lateral direction with a minimal shear force. In one example, the sliding/damping surfaces (e.g., the faces of the dampers 616 and the inside walls 618) comprise mirror finish diamond deformed stainless steel plate against a low surface energy coated plate. In another example, the face of the dampers 616 comprises a textured material, such as the same material as the base plate, and/or has a coating, such as polyester triglycidyl isocyanurate or a low surface energy coating (e.g., EC 2600 for 2% friction). Similarly, the inside walls 618, which are in communication with the face of the dampers 616, may also include a textured material and/or a coating (e.g., EC 2600).

Figure 8:
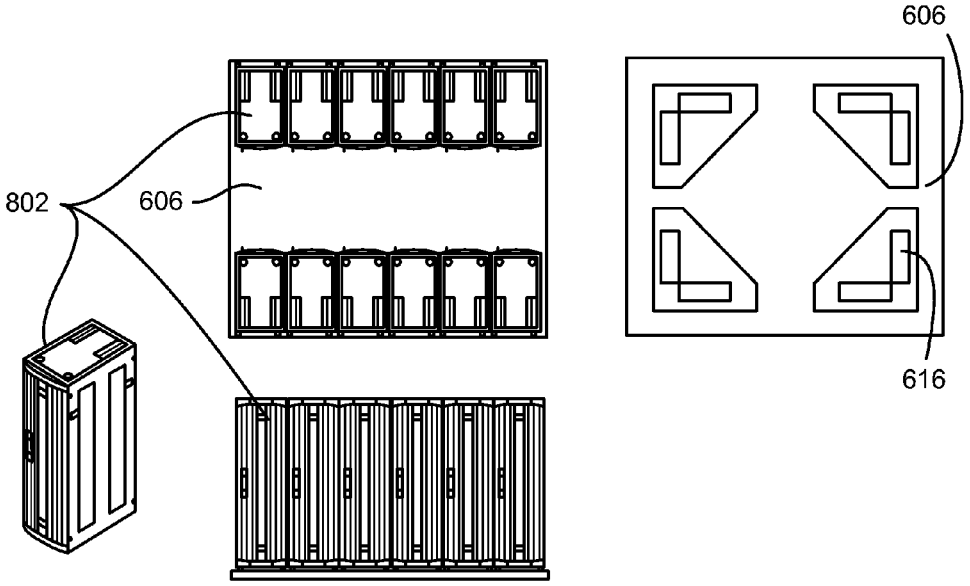
FIG. 8 shows an example configuration of a seismic isolation system with internal dampers installed for a data center room.

As shown in FIG. 8, this configuration can be used in a data center to provide base isolation and protect server cabinets 802 from earthquake damages. In one example, server cabinets 802 are placed in two rows above the concrete slab 606. Eight dampers 618 are mounted within the four corner areas of the concrete slab 606 as described above.

Figure 9:
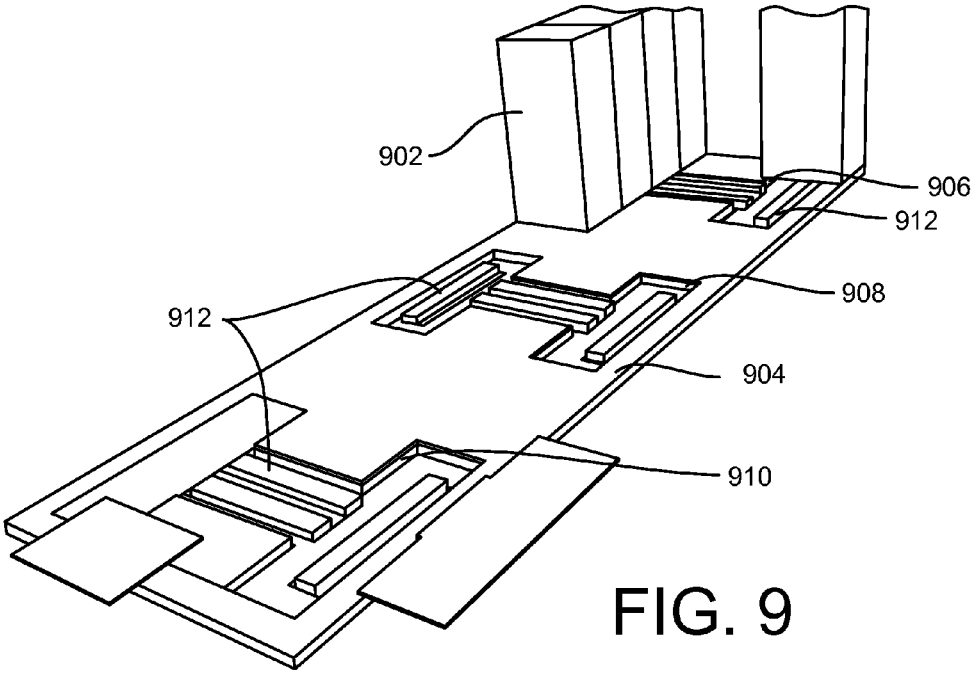
FIG. 9 shows an example two-row data center configuration of a seismic isolation system with internal dampers.
Figure 10:
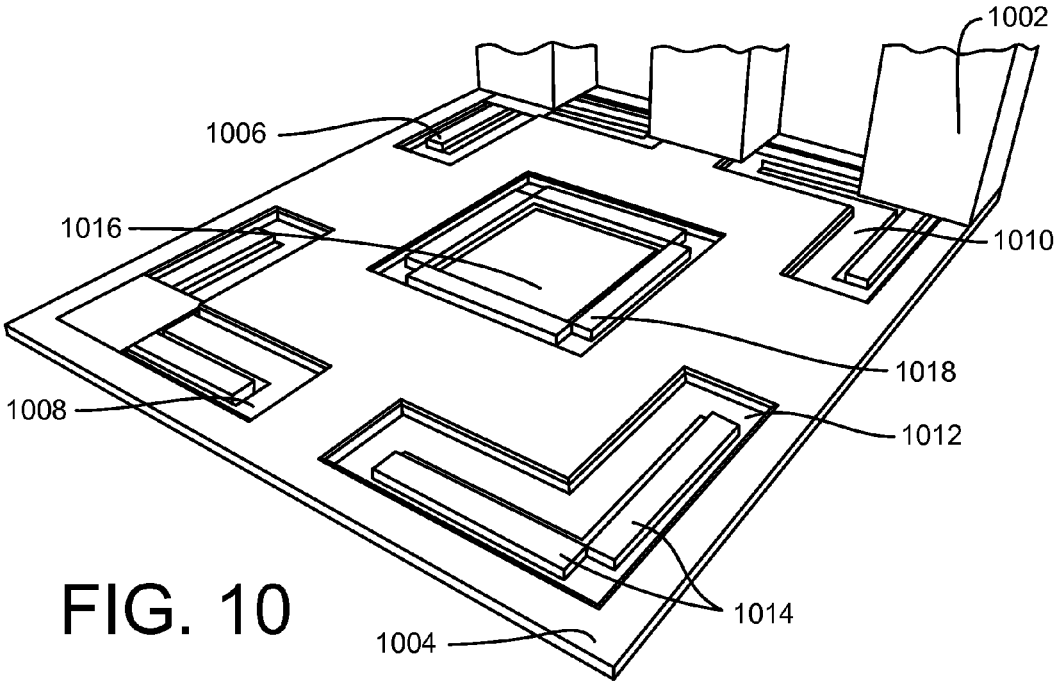
FIG. 10 shows an example three-row configuration of a seismic isolation system with internal dampers.

Moreover, one of ordinary skill in the art would recognize that the size, number, and locations of the internal dampers and/or the recessed areas may vary based on different needs and/or configurations of rooms. FIGS. 9-10 illustrate another two example configurations. FIG. 9 shows a two-row configuration, where server cabinets 902 are placed in two rows on the concrete slab 904. The concrete slab 904 includes three "H"-shaped recessed areas 906, 908, and 910 at its bottom. Under each recessed area, four dampers 912 are mounted in the proximity to the sidewalls of the recessed area. Accordingly, the dampers 912 can limit the motion of the concrete slab 904 in case of an earthquake.

In another example, FIG. 10 shows a three-row configuration where server cabinets 1002 are placed in three rows on the concrete slab 1004. The concrete slab 1004 has four "L"-shaped recessed areas 1006, 1008, 1010, and 1012 at the corners. Under each recessed area, two dampers 1014 are mounted. In addition, the concrete slab 1004 has a square recessed area 1016 in the center. Four additional dampers 1018 are mounted in the proximity to the sidewalls of the recessed area 1016 for providing displacement control.

Figure 11:
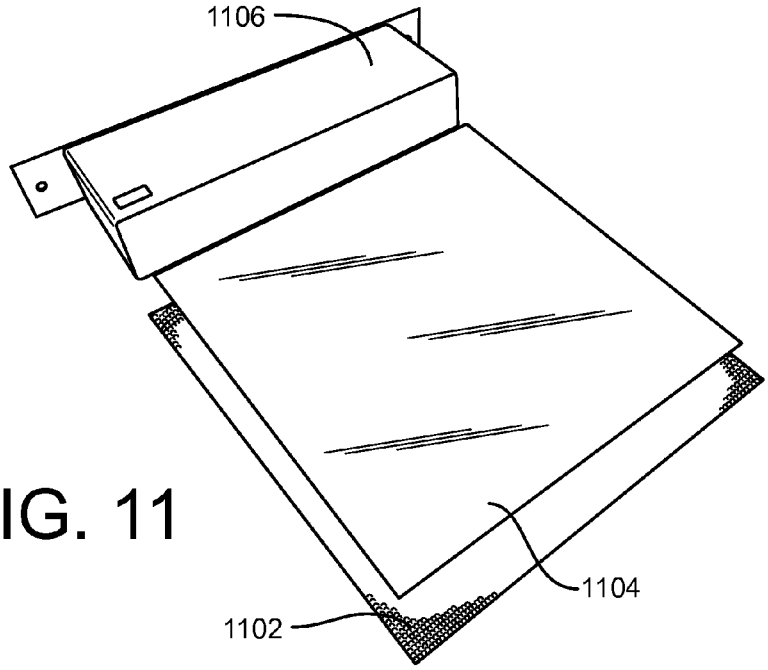
FIG. 11 shows an example base plate, an example top plate, and an example damper in accordance with the present disclosure.

FIG. 11 is a photo showing an example base plate 1102, an example top plate 1104, and an example damper 1106 in accordance with the present disclosure. The base plate 1102 and the top plate 1104 have a shape of rectangle (e.g., square). In one example, the damper 1106 is made of a neoprene sponge material. Tables 5-8 are data sheets describing the properties of four example neoprene damper materials, i.e., "4216-S," "4116-S", "4311-N," and "4511-N."

TABLE 5

| NEOPRENE/EPDM/SBR (Self-Extinguishing) Economy Blend | | 4216-S |
|---|---|---|
| Color: | | Black |
| Specifications: | ASTM D-1056-00 | 2A2 |
| | ASTM D-1056-67$_{(1)}$ | SCE 42 |
| | SAE J18-02 | 2A2 |
| | GM 6086M$_{(3)}$ | II |
| | GMN11106$_{(3)}$ | II |
| 25% Compression Deflection (PSI) | | 5-9 |
| Shore 00 Durometer (Approximate) | | 40-60 |
| Density (Approximate p.c.f.) | | 4½-6½ |
| Water Absorption By Weight | | 5% |
| Temperature Range | | −70 to 158 F. |
| Weather Resistance: | UV | Fair |
| | Ozone | Good |
| Accelerated Linear Shrinkage (Typical) | | 5% |
| Tensile Strength (Typical) | | 50 PSI |
| Elongation (Typical) | | 150% |
| Flammability: | FM VSS No. 302 | Pass |
| | UL 94 HBF | Pass (UL Listed) |
| UL Recognized Component Gasket Materials: (Call Customer Service for Details) | | File No. JMST2 |

TABLE 6

| NEOPRENE/EPDM/SBR (Self-Extinguishing) Economy Blend | | 4116-S |
|---|---|---|
| Color: | | Black |
| Specifications: | ASTM D-1056-00 | 2A1 |
| | ASTM D-1056-67$_{(1)}$ | SCE 41 |
| | SAE J18-02 | 2A1 |
| | GM 6086M$_{(3)}$ | II |
| | GMN11106$_{(3)}$ | II |

TABLE 6-continued

| NEOPRENE/EPDM/SBR (Self-Extinguishing) Economy Blend | | 4116-S |
|---|---|---|
| 25% Compression Deflection (PSI) | | 2-5 |
| Shore 00 Durometer (Approximate) | | 30-50 |
| Density (Approximate p.c.f.) | | 4½-6½ |
| Water Absorption By Weight | | 5% |
| Temperature Range | | −70 to 158 F. |
| Weather Resistance: | UV | Fair |
| | Ozone | Good |
| Accelerated Linear Shrinkage (Typical) | | 5% |
| Tensile Strength (Typical) | | 50 PSI |
| Elongation (Typical) | | 150% |
| Flammability: | FM VSS No. 302 | Pass |
| | UL 94 HBF | Pass (UL Listed) |

TABLE 7

| NEOPRENE/EPDM/SBR BLEND | | 4311-N |
|---|---|---|
| Color: | | Black |
| Specifications: | ASTM D-1056-00 | 2A3 |
| | ASTM D-1056-67$_{(1)}$ | SCE 43 |
| | SAE J18-02 | 2A3 |
| | GM 6086M$_{(3)}$ | IIIA |
| | GMN11106$_{(3)}$ | IIIA |
| 25% Compression Deflection (PSI) | | 9-13 |
| Shore 00 Durometer (Approximate) | | 50-70 |
| Density (Approximate p.c.f.) | | 8-13 |
| Water Absorption By Weight | | 5% |
| Temperature Range | | −70 to 225 F. |
| Weather Resistance: | UV | Fair |
| | Ozone | Good |
| Accelerated Linear Shrinkage (Typical) | | 10% |
| Tensile Strength (Typical) | | 70 PSI |
| Elongation (Typical) | | 120% |
| Flammability: | FM VSS No. 302 | Pass |

TABLE 8

| NEOPRENE/EPDM/SBR BLEND | | 4511-N |
|---|---|---|
| Color: | | Black |
| Specifications: | ASTM D-1056-00 | 2A5 |
| | ASTM D-1056-67$_{(1)}$ | SCE 45 |
| | SAE J18-02 | 2A5 |
| | GM 6086M$_{(3)}$ | IIIB |
| | GMN11106 | IIIB |
| 25% Compression Deflection (PSI) | | 17-24 |
| Shore 00 Durometer (Approximate) | | 65+ |
| Density (Approximate p.c.f.) | | 12-20 |
| Water Absorption By Weight | | 5% |
| Temperature Range | | −70 to 225 F. |
| Weather Resistance: | UV | Fair |
| | Ozone | Good |
| Accelerated Linear Shrinkage (Typical) | | 5% |
| Tensile Strength (Typical) | | 90 PSI |
| Elongation (Typical) | | 100% |
| Flammability: | FM VSS No. 302 | Pass |

In another example, the face of the damper 1106 may comprise a textured material, such as the same material as the textured surface of the base plate, and/or a coating (e.g., coating EC 2600 for 2% friction) to achieve desired coefficients of static and kinetic friction. In operation, the face of the damper 1106 may be in communication with an inside wall of a slab, wherein the contacting surface of the inside wall may also comprise a textured material (e.g., the same material as the base plate) and/or a coating (e.g., EC 2600) to reduce shear forces and to allow the slab to slide along the face of the damper without damage. Moreover, one of ordinary skill in the art will recognize that the size or shape of each plate or damper may vary as desired.

Figure 12:
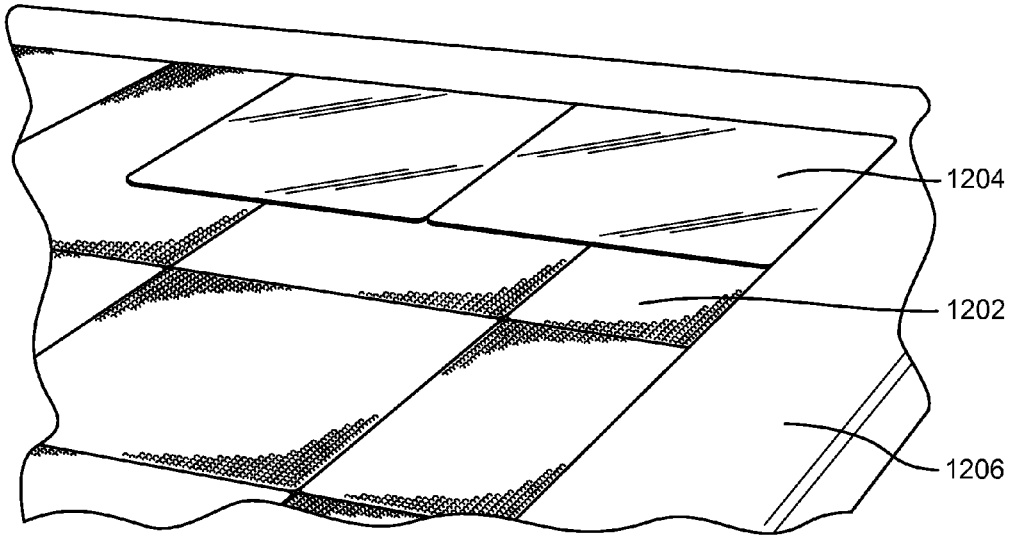
FIG. 12 illustrates an example installation process of a seismic isolation system in accordance with the present disclosure.
Figure 13:
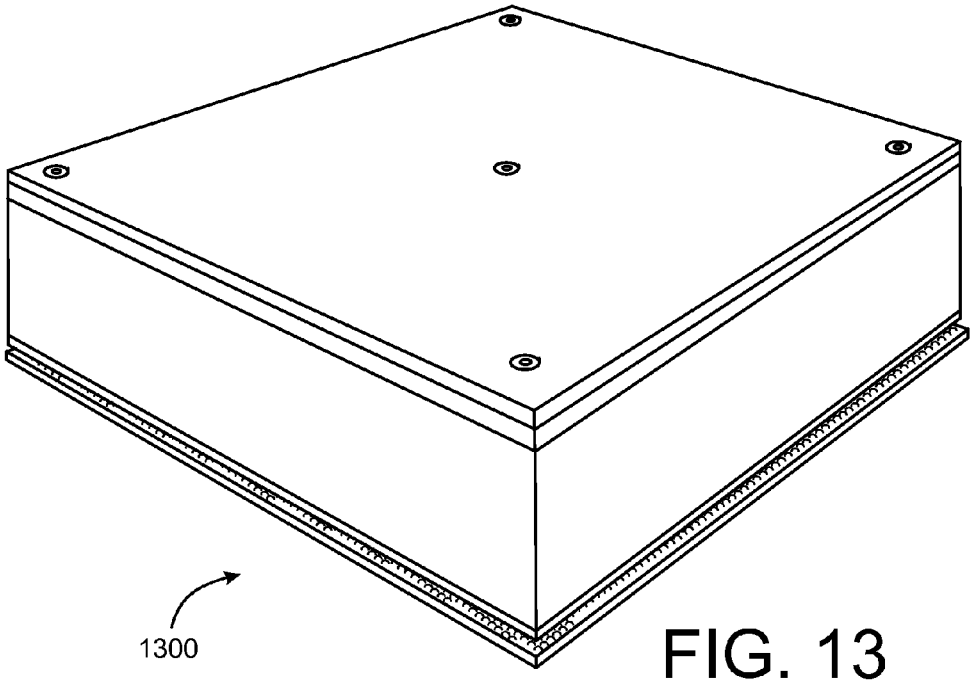
FIG. 13 illustrates a top perspective view of an example base isolation pedestal assembly in accordance with the teachings of the present disclosure.

FIG. 12 is a photo depicting the installation process of a seismic isolation system in accordance with the present disclosure. The base plates 1202 include multiple lines of rectangle plates attached to the upper surface of the foundation 1206. The top plates 1204 include multiple rectangle plates installed on the base plate 1202. One of ordinary skill in the art will also recognize that the number, size, or shape of each plate to be installed may vary as desired.

Referring now to FIGS. 13-16, there is illustrated an example pedestal base isolation system assembly 1300. In this example, the assembly 1300 includes a base plate 1310, such as the base plate 100, and a top plate 1312, such as the top plate 102. As with at least some of the previous examples, the base plate 1310 and the top plate 1312 are slidably coupled such that the plates do not slide under normal operation, but are capable of sliding relative to one another during a seismic event. Further, in this example at least one of the base plate 1310 and the top plate 1312 comprise a coating, such as a polymer, to influence the coefficients of static friction and kinetic friction to affect the desired movement characteristics.

Figure 14:
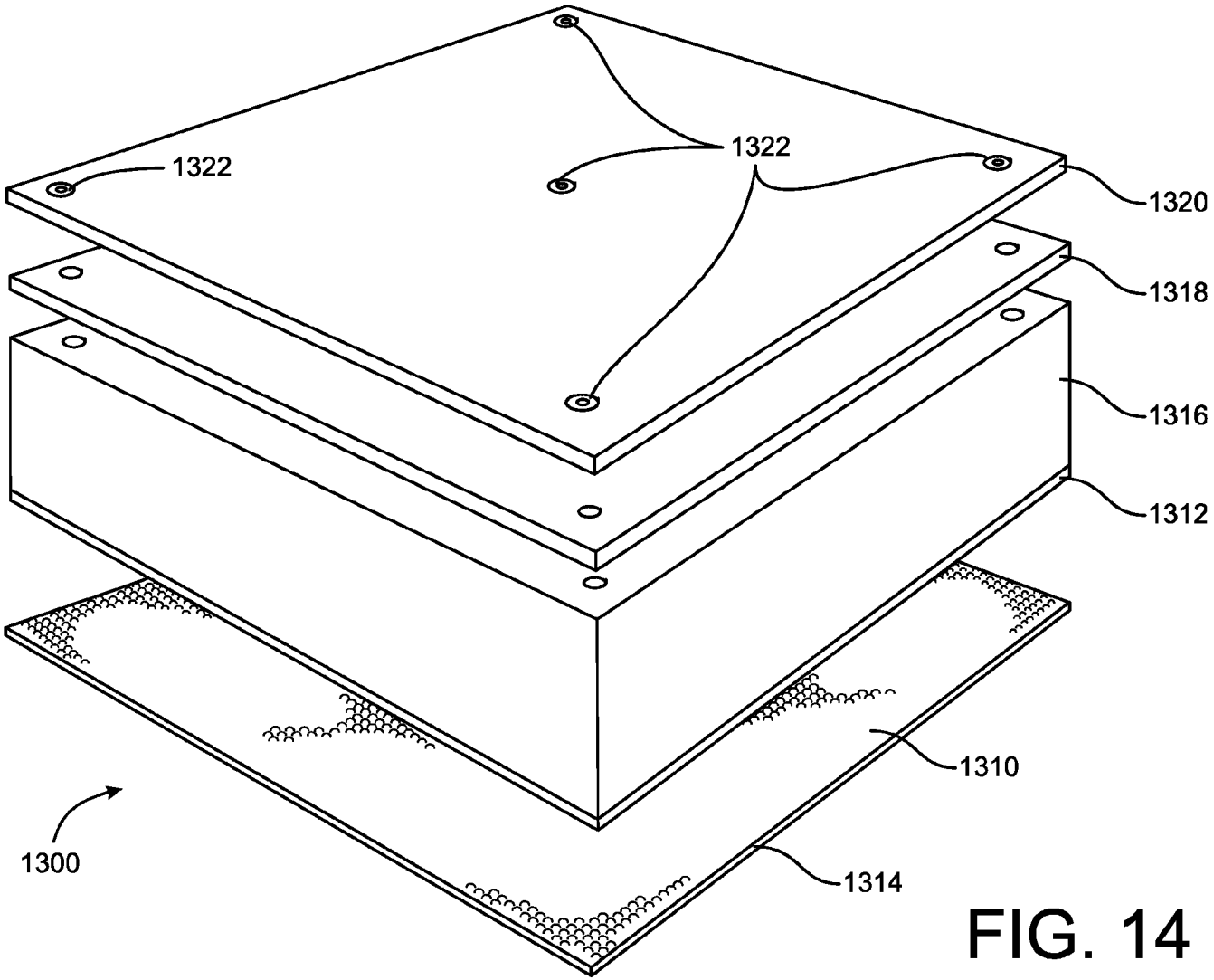
FIG. 14 is an exploded perspective view of the example base isolation pedestal assembly of FIG. 13.

As illustrated in FIG. 14, the base plate 1310 may include an anchoring layer 1314, such as for instance, a high-friction layer such as a rubber, a synthetic rubber, adhesive, or any other suitable layer. In the illustrated example, the layer 1314 is a neoprene (polychloroprene) layer to significantly prevent relative movement between the base plate 1310 and the flooring upon which it rests while also substantially preventing damage to the flooring by eliminating the need for floor fasteners, and preventing scratches, marks, etc. This anchoring layer 1314 may be especially useful in situations where the assembly 1300 is utilized in delicate locations, such as for instance, on the floor of a museum, historical location, etc.

Figure 15:
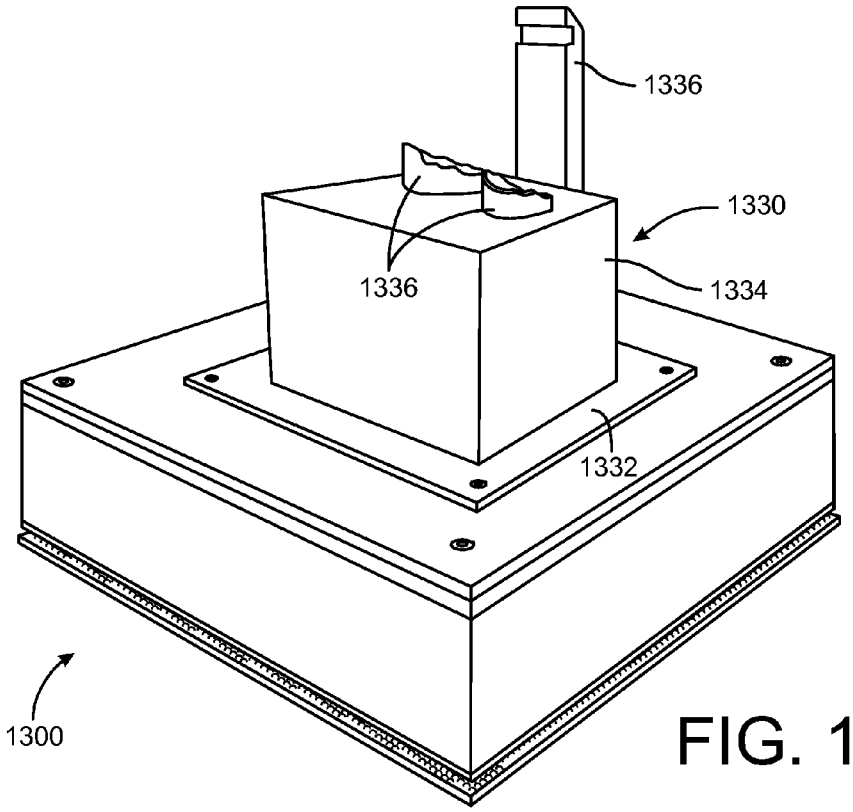
FIG. 15 illustrates a top perspective view of the example base isolation pedestal assembly of FIG. 13 showing a mounted museum piece harness.

Referring to the top plate 1312, the example top plate 1312 includes a pedestal 1316, and optional receiver plates 1318, 1320. It will be appreciated that the receiver plates 1318, 1320 may be individually eliminated and/or integrated into the construction of the pedestal 1316 as desired. In this example, each of the pedestal 1316 and the receiver plates 1318, 1320, include at least one fastening aperture 1322 such that the plates 1318, 1320 can be fastened (e.g., bolted) to the pedestal 1316 if necessary. Furthermore, as illustrated in FIG. 15, the apertures 1322 may be utilized to fasten a suitable support device to the assembly 1300 as desired. For instance, in the illustrated example the assembly 1300 may be utilized to support a museum quality statute (not shown) via a suitable harness 1330 which may be fastened to any of the pedestal 1316 and plates 1318, 1320, as desired. In particular, in the illustrated example, the harness 1330 includes a mounting plate 1332, an additional pedestal 1334, a supporting arm 1336, and a pair of supports 1338. In this example, the supports 1338 are custom molded to support a statue having an irregular base, and the example support arm 1336 is adapted to mechanically couple to the statue directly and/or through braces, brackets, etc. It will be appreciate by one of ordinary skill in the art that the arrangement and construction of the harness 1330 may vary according to the desired support characteristics.

Figure 16:
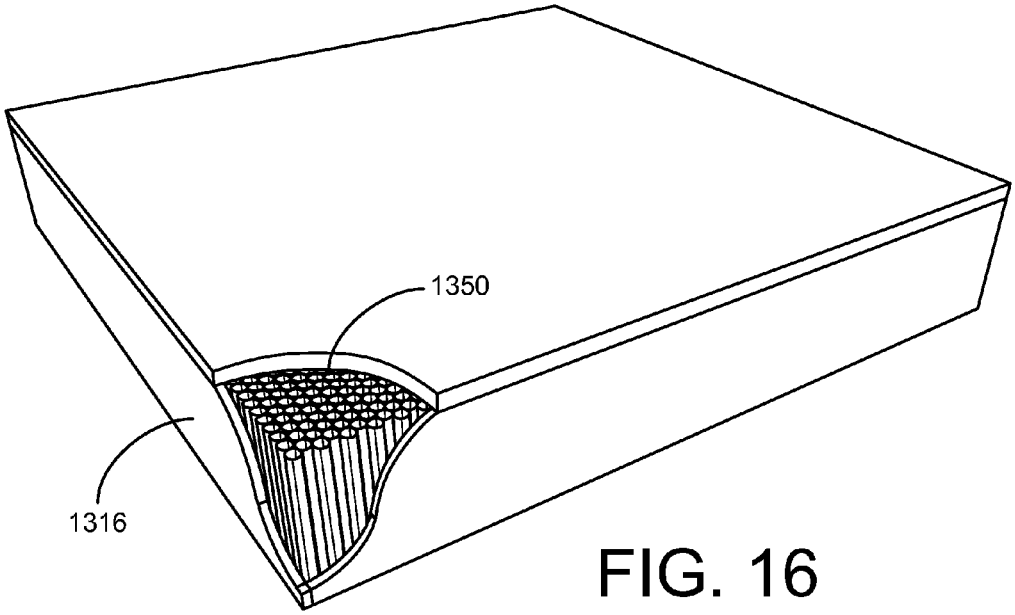
FIG. 16 is a detailed perspective view of an example pedestal for use with the assembly of FIG. 13 with the inner construction partially revealed.

Still further, it will be appreciated by one of ordinary skill in the art that the pedestal 1316, plates 1318, 1320, and/or harness 1330 may be arranged into any suitable shape, size, weight, etc. In the present example, at least the pedestal 1316 comprises a light weight design. For instance, as illustrated in FIG. 16, the example pedestal 1316 comprises an expanded aluminum structure having a lightweight, honeycomb arrangement 1350. In this instance, the pedestal 1316 provides a sufficient strength to adequately support the object mounted to the assembly 1300, while reducing the weight and material usage of the pedestal, which may provide benefits, such as ease of installation, etc. It will be appreciated, however, that the material choice and construction of any component of the assembly 1300 may be modified and/or chosen as desired or required for the specific support application.

Although certain example methods and apparatus have been described herein, the scope of coverage of this patent is not limited hereto. On the contrary, this patent covers all methods, apparatus, and articles of manufacture fairly falling within the scope of the appended claims either literally or under the doctrine of equivalent.

We claim:

1. A pedestal base isolation system assembly comprising:
a base plate having a bottom surface and a top surface;
an anchoring layer at least partially covering the bottom surface of the base plate;
a top plate slidably positioned above the top surface of the base plate and having a bottom surface and a top surface;
a pedestal mounted to the top surface of the top plate;
wherein at least one of the top surface of the base plate or the bottom surface of the top plate includes a textured surface; and
a coating at least partially covering at least one of the top surface of the base plate or the bottom surface of the top plate, the coating providing a coefficient of static and kinetic friction between the top plate and the base plate that prevents relative movement of the two plates with normal operation and yet allows the top plate to move relative to the base plate during a seismic event, wherein the coating comprises a silicone epoxy.

2. A pedestal base isolation system assembly as recited in claim 1, wherein the pedestal comprises a honeycomb construction.

3. A pedestal base isolation system assembly as recited in claim 1, wherein the anchoring layer comprises neoprene.

4. A pedestal base isolation system assembly as recited in claim 3, wherein the anchoring layer is mounted to a support surface.

5. A pedestal base isolation system assembly as recited in claim 1, wherein the textured surface comprises diamond-shaped ridges.

6. A pedestal base isolation system assembly as recited in claim 1, wherein a lubricant is deposited between the base plate and the top plate.

7. A seismic isolation system comprising:
a base plate having a textured top surface;
a top plate positioned above the base plate and having a non-textured bottom surface; and
a coating integrally formed with and at least partially covering one or more of the top surface of the base plate or the bottom surface of the top plate, wherein the coating provides a coefficient of static and kinetic friction between the top plate and the base plate that prevents relative movement of the two plates with normal operation and yet allows the top plate to move relative to the base plate during a seismic event, wherein the coating comprises a silicone epoxy.

8. A seismic isolation system as recited in claim 7, wherein base plate is mounted to a foundation.

9. A seismic isolation system as recited in claim 7, wherein the bottom surface of the base plate is textured.

10. A seismic isolation system as recited in claim 7, wherein at least one of the top surface or the bottom surface of the base plate is textured with diamond-shaped ridges.

11. A seismic isolation system as recited in claim 7, wherein a lubricant is deposited between the base plate and the top plate.

12. A seismic isolation system comprising:
a base plate having a textured top surface;
a top plate positioned above the base plate and having a non-textured bottom surface;
a coating integrally formed with and at least partially covering one or more of the top surface of the base plate or the bottom surface of the top plate, wherein the coating provides a coefficient of static and kinetic friction between the top plate and the base plate that prevents relative movement of the two plates with normal operation and yet allows the top plate to move relative to the base plate during a seismic event, wherein the coating comprises a silicone epoxy; and
a pedestal mounted to the top surface of the top plate.

13. A seismic isolation system as recited in claim 12, wherein base plate is mounted to a foundation.

14. A seismic isolation system as recited in claim 12, wherein the bottom surface of the base plate is textured.

15. A seismic isolation system as recited in claim 12, wherein at least one of the top surface or the bottom surface of the base plate is textured with diamond-shaped ridges.

16. A seismic isolation system as recited in claim 12, wherein a lubricant is deposited between the base plate and the top plate.

17. A seismic isolation system as recited in claim 12, wherein the pedestal comprises a honeycomb construction.

* * * * *